US005629050A

United States Patent [19]

Silvis et al.

[11] Patent Number: 5,629,050

[45] Date of Patent: May 13, 1997

[54] PROCESS FOR PREPARING COATED ARTICLES

[75] Inventors: H. Craig Silvis; Susan J. Babinec; Robert A. Cipriano, all of Midland, Mich.

[73] Assignee: The Dow Chemical Company, Midland, Mich.

[21] Appl. No.: 521,482

[22] Filed: Aug. 30, 1995

[51] Int. Cl.[6] ..... B05D 1/04

[52] U.S. Cl. ..... 427/475; 204/164; 204/165; 252/500; 427/485

[58] Field of Search ..... 204/164, 165, 204/166, 167; 427/475, 485, 121, 383.1, 393.5; 252/500

[56] References Cited

U.S. PATENT DOCUMENTS

| | | | |
|---|---|---|---|
| 3,645,992 | 2/1972 | Elston | 260/30.78 |
| 4,557,807 | 12/1985 | Preston et al. | 204/4 |
| 4,670,511 | 6/1987 | Weddigen et al. | 525/138 |
| 4,851,487 | 7/1989 | Yaniger et al. | 525/540 |
| 4,855,361 | 8/1989 | Yaniger et al. | 525/436 |
| 4,929,388 | 5/1990 | Wessling | 252/500 |
| 4,935,163 | 6/1990 | Cameron | 252/500 |
| 4,935,164 | 6/1990 | Wessling et al. | 252/500 |
| 4,963,206 | 10/1990 | Shacklette et al. | 156/99 |
| 4,983,690 | 1/1991 | Cameron et al. | 525/436 |
| 5,002,700 | 3/1991 | Otagawa et al. | 252/500 |
| 5,006,278 | 4/1991 | Elsenbaumer | 427/385.5 |
| 5,055,544 | 10/1991 | Harris et al. | 528/59 |
| 5,071,593 | 12/1991 | Takahashi et al. | 252/500 |
| 5,077,330 | 12/1991 | Ehrhart et al. | 524/314 |
| 5,134,177 | 7/1992 | Aklonis et al. | 523/201 |
| 5,160,457 | 11/1992 | Elsenbaumer | 252/500 |
| 5,182,050 | 1/1993 | Joyce, Jr. et al. | 252/500 |
| 5,187,228 | 2/1993 | Perron et al. | 525/66 |
| 5,188,766 | 2/1993 | Eiffler | 252/500 |
| 5,188,783 | 2/1993 | Pierce | 264/104 |
| 5,198,521 | 3/1993 | Ehrhart et al. | 528/48 |
| 5,217,649 | 6/1993 | Kulkarni et al. | 252/500 |
| 5,225,109 | 7/1993 | Feldhues et al. | 252/500 |
| 5,232,631 | 8/1993 | Cao et al. | 252/500 |
| 5,247,001 | 9/1993 | Lacour | 524/398 |
| 5,254,633 | 10/1993 | Han et al. | 525/327.4 |
| 5,262,483 | 11/1993 | Jongeling | 525/185 |
| 5,272,236 | 12/1993 | Lai et al. | 526/348.5 |
| 5,278,241 | 1/1994 | Patil et al. | 525/274 |
| 5,290,483 | 3/1994 | Kulkarni et al. | 252/500 |
| 5,346,649 | 9/1994 | Kärnä et al. | 252/500 |
| 5,370,825 | 12/1994 | Angelopoulos et al. | 252/500 |
| 5,378,402 | 1/1995 | Cross et al. | 252/500 |
| 5,427,715 | 6/1995 | Ohwa et al. | 252/500 |
| 5,435,932 | 7/1995 | Bryant et al. | 252/77 |
| 5,437,806 | 8/1995 | Bryant et al. | 252/77 |
| 5,482,655 | 1/1996 | Vogel et al. | 252/500 |
| 5,489,400 | 2/1996 | Liu et al. | 252/500 |

FOREIGN PATENT DOCUMENTS

| | | |
|---|---|---|
| 2093952 | 4/1993 | Canada . |
| 0058916 | 2/1982 | European Pat. Off. . |
| 0363103 | 9/1989 | European Pat. Off. . |
| 0528178 | 7/1992 | European Pat. Off. . |
| 0565237 | 3/1993 | European Pat. Off. . |
| 0582919 | 7/1993 | European Pat. Off. . |
| 2214511 | 9/1989 | United Kingdom . |
| 9305519 | 3/1993 | WIPO . |
| 9314166 | 7/1993 | WIPO . |
| 9407612 | 4/1994 | WIPO . |

OTHER PUBLICATIONS

Kathirgamanathan, P., *Curable Electrically Conductive Resins with Polyaniline Fillers,* Polymer, vol. 34, No. 13, pp. 2907–2908 (1993).

Bi et al., *An Electrically–Conductive Composite Prepared by Electrochemical Polymerization of Pyrrole Into Polyurethane,* Synthetic Metals, vol. 22, pp. 145–156 (1987).

Chemical Abstracts, 122:315620 (1995).

Chemical Abstracts, 122:266862 (1995).

Engler, Edward, *Organic Metals,* Chemtech, pp. 274–279, Apr. (1976).

Shacklette et al., *Polyaniline Blends in Thermoplastics,* Synthetic Metals, pp. 3532–3537 (1993).

Teriemezyan et al., *Electrically Conductive Polymer Blends Comprising Polyaniline,* Polymer Bulletin, vol. 29, pp. 283–287 (1992).

Pei et al., *Electrochemical Preparation of Electrically Conducting Polyurethane/Polyaniline Composite,* Journal of Applied Polymer Science, vol. 38, pp. 1819–1828 (1989).

Hanack et al., *Conducting Stacked Metallophthalocyanines and Related Compounds,* Adv. Mater., vol. 6, No. 11, pp. 819–851 (1994).

Chen et al., *Structure and Properties of Poly(acrylic acid-)–Doped Polyaniline,* Macromolecules, vol. 28, pp. 2858–2866 (1995).

Liao et al., *Doping of Polyaniline with Polymeric Dopants in Solid State, Gel State and Solutions,* Polymers for Advanced Technologies, vol. 6, pp. 47–51 (1995).

*New RIM PUR System Combines Conductivity with Downgauging,* Plastics Technology, Feb., p. 13 (1995).

Bergeron et al., *Electrical and Physical Properties of New Electrically Conducting Quasi Composites. Poly(aniline–co–N–butylaniline) Copolymers,* Macromolecules, vol. 25, pp. 3332–3337 (1992).

Banerjee et al., *Conducting Polyaniline Nanoparticle Blends with Extremely Low Percolation Thresholds,* vol. 28, pp. 3940–3943 (1995).

(List continued on next page.)

*Primary Examiner*—Michael Lusignan

[57] ABSTRACT

A process for preparing a coated article which includes the step of electromotively coating an article molded or extruded from a composition having a conductivity of at least about $10^{-14}$ Siemens/cm (S/cm) comprising (a) a thermoplastic polymer, thermoset polymer, or mixture thereof and (b) an electronically conductive charge transfer complex or inherently semiconducting polymer different from (a). It has been discovered that the process of the invention provides a means by which electromotively coated polymer articles may be conveniently prepared.

21 Claims, No Drawings

OTHER PUBLICATIONS

Ikkala et al., *Counter–Ion Induced Processibility of Polyaniline: Conducting Melt Processible Polymer Blends,* Synthetic Metals, vol. 69, pp. 97–100 (1995).
Chiu et al., *The Processing and Mechanical Properties of Polypyrrole/Polyurethane Alloy Films,* Journal of Applied Electrochemistry, vol. 22, pp. 528–534 (1992).
Chiu et al., *The Morphology and Conductivity of Polypyrrole/Polyurethane Alloy Films,* Journal of Applied Electrochemistry, vol. 22, pp. 358–363 (1992).
Pun et al., *Protonation of Polyaniline by Surface–Functionalized Polymer Substrates,* Journal of Applied Polymer Science, vol. 56, pp. 355–364 (1995).
Yosomiya et al., *Electrical Properties of Polypyrrole–Polymer Composite Films,* Makromol. Chem., Rapid Commun., vol. 7, pp. 697–701 (1986).
Yang et al., *Scanning Tunneling Microscope Study of Electropolymerized Polypyrrole with Polymeric Anion,* Langmuir, vol. 7, pp. 556–558 (1991).
Chauvet et al., *Magnetic and Transport Properties of Polypyrrole Doped with Polyanions,* Synthetic Metals, vol. 63, pp. 115–119 (1994).
Maeda et al., *Synthesis and Characterization of Carboxylic Acid–Functionalized Polypyrrole–Silica Microparticles,* Macromolecules, vol. 28, pp. 2905–2911 (1995).
Zheng et al., *Characterization and Solid–State Properties of Processable N–Alkylated Polyanilines in the Neutral State,* Macromolecules, vol. 27, pp. 7754–7768 (1994).
Wei et al., *Chemical and Electrochemical Copolymerization of Aniline with Alkyl Ring–Substituted Anilines,* Macromolecules, vol. 23, pp. 758–764 (1990).
Derwent 90–272705/36 (1990).
Derwent 89–260968/36 (1989).
Balberg et al., *Excluded Volume and Its Relation to the Onset of Percolation,* Physical Review B, vol. 30, No. 7, pp. 3933–3943 (1984).
MacDiarmid et al., *Polyaniline: A New Concept in Conducting Polymers,* Synthetic Metals, vol. 18, pp. 285–290 (1987).
*Standard Test Method for Tensile Properties of Plastics,* ASTM, Designation: D 638–87b, pp. 18–29 (1988).
*Standard Test Method for High–Speed Puncture Properties of Plastics Using Load and Displacement Sensors,* ASTM, Designation: D 3763–86, pp. 52–56 (1986).

PROCESS FOR PREPARING COATED ARTICLES

BACKGROUND OF THE INVENTION

This invention relates to electronically conductive polymers, and more particularly to composite articles or polymer blends containing electronically conductive polymers.

It is known to prepare coated articles by electrostatic painting methods. In such methods, a paint or coating is charged or ionized and sprayed on a grounded article, and the electrostatic attraction between the paint or coating and a grounded, conductive article results in a more efficient painting process with less wasted paint material, and thicker and more consistent paint coverage, particularly when the article has a complex shape. When articles fabricated from metals are painted, the metal, which is inherently conductive, is easily grounded and efficiently painted. In recent years, there has been an emphasis on the use of polymeric materials in the manufacture of articles, particularly in applications requiring reductions in weight and improved corrosion resistance, such as automotive applications. However, polymers typically used in such processes are insufficiently conductive to efficiently obtain a satisfactory paint thickness and coverage when the article is electrostatically painted.

One method that has been used to prepare electrostatically coated polymers is to employ compositions containing conductive fibers, such as described in European Patent Application No. 363,103. However, adding such large amounts of fibrous fillers to a polymer can adversely affect both the polymer's physical properties and paint finish. U.S. Pat. No. 5,188,783 discloses a method for making electrostatically coated articles from composites containing ion-conductive polymers. However, such articles may be less conductive than desirable for use in electrostatic coating processes.

PCT Publication No. WO 94/07612 discloses a process for preparing electrostatically paintable polyurethane compositions by the incorporation of ion-conductive metal salts. However, the conductivity of such compositions may be less than desirable for certain electrostatic painting processes.

SUMMARY OF THE INVENTION

In one aspect, this invention is a process for preparing a coated article which includes the step of electromotively coating an article molded or extruded from a composition having a conductivity of at least about $10^{-14}$ Siemens/cm (S/cm), which comprises a mixture of (a) a thermoplastic polymer, thermoset polymer, or mixture thereof and (b) an electronically conductive charge transfer complex or inherently semiconducting polymer different from (a).

It has been discovered that the process of the invention provides a means by which electromotively coated polymer articles may be conveniently prepared. These and other advantages of the invention will be apparent from the description which follows.

DETAILED DESCRIPTION OF THE INVENTION

The term "electronically conductive charge transfer complex" as used herein refers to two organic or inorganic molar species, or combinations thereof, which are sufficiently associated to result in a partial or total transfer of electrons between the species. Such complexes may be formed, for example, via hydrogen bonds or ionic bonds, such as polyaniline association with lithium. Suitable electronically conductive charge transfer complexes for use in the process of the invention include (1) any polymer with extended pi-conjugated groups, which has been rendered conductive with a charge transfer or redox agent to provide a conductivity of at least about $10^{-12}$ S/cm, and (2) pi-stacking compounds.

The polymers with extended pi-conjugated groups are referred to hereafter collectively as "intrinsically conductive polymers", or "ICPs". The process of rendering the polymer conductive is referred to herein as "doping". ICPs which have been rendered conductive and have not been rendered conductive are referred to herein as "doped"ICPs and "undoped" ICPs, respectively. The compounds and polymers which may be used in such doping processes to render the ICPs conductive are referred to herein as "dopants". Polymers useful as component (a) of the composition are referred to herein as "matrix" polymers, even though they may comprise substantially less than 50 percent of the polymers present in the composition. The compositions comprised of components (a) and (b) are referred to herein as "composites".

Examples of pi-stacking compounds include tetrathiotetracene, metallophthalocyanines, tetracyano-p-quinodimethane, tetrathiofulvalene, tetracyano-p-quinodimethane-tetrathiofulvalene, N-methylphenazinium-tetracyano-p-quinodimethane, and mixtures thereof.

Examples of suitable ICPs include polyanilines, polyacetylenes, poly-p-phenylenes, polypyrroles, polythiophenes, poly(phenylene sulfide), polyindole, derivatives thereof, such as poly(3-alkylthiophene) and poly(o-methoxy aniline), and mixtures thereof. Preferably, the ICP is a polyaniline, polypyrrole, or polythiophene, but is most preferably a polyaniline. However, the choice of ICP may also depend on its compatibility with the particular thermoplastic or thermoset matrix polymer (component (a)), as discussed below. For example, polypyrrole is especially compatible with polymers with which it can form hydrogen bonds along its backbone; polyalkylthiophenes are particularly compatible with polyolefins and polystyrene; and polyacetylenes are particularly compatible with polyolefins.

The polymeric form of the ICP may be used to prepare the composites useful in the process of the invention, either by blending the ICP with the matrix polymer, or polymerizing the matrix polymer in situ from a dispersion of the corresponding monomer in the ICP. Alternatively, the monomeric form of the ICP may be dissolved or dispersed in the matrix polymer and the ICP polymerized in situ, or both the ICP and matrix polymer may be polymerized together in situ. In another embodiment of the invention, a graft-copolymer of a thermoplastic polymer and nitrogen-containing compound may be utilized as the component (b). An example of a method for preparing such a copolymer is illustrated in U.S. Pat. No. 5,278,241. Examples of suitable inherently semiconducting polymers include undoped polythiophene.

The optimum amount of component (b) used to prepare the composite will typically depend on the conductivity of the electronically conductive complex or semiconducting polymer, the relative cost of such complex or polymer, and the desired conductivity and physical properties of the article which is to be electromotively coated. Component (b) is preferably present in an amount, based on the weight of the composite, of at least about 0.1 percent; but no more than about 25 percent, more preferably no more than about 20 percent, and most preferably no more than about 10 percent. However, if a high molecular weight dopant is utilized, a greater amount of the component (b) may be necessary to provide a desired conductivity, since the undoped ICP would represent a proportionately smaller part of the component (b). Similarly, if component (b) is prepared as a graft copolymer of an ICP and an insulating polymer, a greater amount of the component (b) may be necessary to provide a desired conductivity, since the conductive portion of the polymer would be proportionately smaller.

The ICP may be doped by any suitable method prior to being utilized in the preparation of the composite. Of course, the effectiveness of the various doping methods and the conductivity of the doped ICP obtained thereby will vary depending on the doping method, the particular ICP, the particular dopant, and the point in the fabrication process at which the ICP is doped. The ICP may be doped, for example, by mixing a solution or dispersion of a dopant with the ICP either in solution or with the ICP in the solid state, contacting a solid ICP with a solid dopant (solid state doping), or by contacting a solid ICP with a dopant in vapor form.

The amount of dopant to be used in the preparation of the doped ICP and the composite will depend on several factors, including the desired conductivity of the ICP and the composite, the physical, thermal, and/or solution processing characteristics of components (a) and (b), as well as their compatibility with each other. In general, a polyaniline ICP will reach a maximum conductivity when it is supplied in an amount sufficient to dope about 50 mole percent of the available sites. Other types of ICPs will typically reach a maximum conductivity at a somewhat lower level of doping such as, for example, about 30 mole percent of the available sites for polypyrroles and polythiophenes. The amount of dopant necessary to reach the maximum conductivity for the ICP will depend on (1) the particular ICP utilized (2) its chemical purity and (3) the distribution of the dopant within the ICP matrix. Preferably, the amount of dopant utilized does not greatly exceed the amount which is needed to dope the polymer for cost reasons, and because the excess dopant may have a tendency to leach out of the composite containing the doped polymer and excess dopant.

Polyaniline can occur in several different forms such as leucoemeraldine, protoemeraldine, emeraldine, nigraniline, and pernigraniline, depending on the ratio of amine groups to imine groups present in the backbone of the polymer. The emeraldine salt form of polyaniline, in which about 50 percent of the nitrogen atoms are contained in imine groups, is a very conductive and stable form of polyaniline, when doped.

Examples of suitable dopants for polyaniline include any salt, compound, or polymer capable of introducing a positively charged site on the polyaniline, including both partial and full charge transfer such as, Lewis acids, Lowry-BrØnsted acids, and the alkali metal, alkaline earth metal, ammonium, phosphonium, and transition metal salts thereof; and other redox agents having a sufficiently oxidizing oxidative couple to dope the polyaniline; alkyl or aryl halides; and acid anhydrides.

Examples of suitable Lewis acids and Lowry-BrØnsted acids include those described in U.S. Pat. No. 5,160,457, the "functionalized protonic acids" described in U.S. Pat. No. 5,232,631 and the "polymeric dopants" described in U.S. Pat. No. 5,378,402, all of which are hereby incorporated by reference. Specific examples include hydrogen chloride, sulfuric acid, nitric acid, $HClO_4$, $HBF_4$, $HPF_6$, HF, phosphoric acids, picric acid, m-nitrobenzoic acids, dichloroacetic acid, selenic acid, boronic acid, organic sulfonic acids, inorganic clusters of polyoxometallates, and higher molecular weight polymers having terminal or pendant carboxylic, nitric, phosphoric, or sulfonic acid groups, salts, esters, and diesters thereof, or mixtures thereof.

Other examples of dopants include ethylene/acrylic acid copolymers; polyacrylic acid; ethylene/methacrylic acid copolymers; carboxylic acid-or sulfonic acid-capped polystyrene, polyalkylene oxides, and polyesters; and graft copolymers of polyethylene or polypropylene and acrylic acid or maleic anhydride as well as mixtures thereof; sulfonated polycarbonates, sulfonated ethylene-propylene-diene terpolymers (EPDM), sulfonated polystyrene, sulfonated ethylene-styrene copolymers, polyvinylsulfonic acid, sulfonated poly(phenylene oxide), and sulfonated polyesters such as polyethylene terephthalate; as well as the alkali metal, alkaline earth metal, transition metal, ammonium, and phosphonium salts of such acids, preferably the lithium, manganese, and zinc salts of such acids. Examples of suitable alkylation agents include those corresponding to the formula R—X, wherein R is a $C_{1-5}$ alkyl group or aryl group, and X is Cl, Br, or I. Examples of suitable acid anhydrides include maleic anhydride and phthalic anhydride.

ICPs other than polyaniline may be doped with transition metal salts such as, $CuCl_2$, $CeCl_3$, $FeCl_3$, and $Fe2(SO_4)_3$, or other redox agent having a sufficiently oxidizing oxidative couple to dope the ICP, such as $AsF_5$, $NOPF_6$, $I_2$, $Br_2$, or $Cl_2$. The doped ICP preferably has a conductivity of at least about $10^{-12}$ S/cm, more preferably at least about $10^{-6}$ S/cm, and most preferably at least about 1 S/cm.

Suitable thermoplastic polymers for use in the process of the invention preferably have a glass transition temperature in the range of from about −100° C. to about 300° C. Examples of such polymers include polyolefin polymers and copolymers such as polypropylene, polyethylene, poly(4-methylpentene), and poly(ethylene-vinyl acetate); styrenic polymers and copolymers such as polystyrene, syndiotactic polystyrene, poly(styrene-acrylonitrile) or poly(styrene-maleic anhydride); polysulfones; polyethersulfones; poly (vinyl chloride); aliphatic or aromatic polyesters such as poly(ethylene terephthalate) or poly(butylene terephthalate); aromatic or aliphatic polyamides such as nylon 6, nylon 6,6 and nylon 12; polyacetal; polycarbonate; thermoplastic polyurethanes; modified polyphenylene oxide; polyhydroxy ethers; polyphenylene sulfide; poly(ether ketones); poly (methyl methacrylate); as well as mixtures thereof. Suitable polyolefins also include high and low density polyethylenes and polypropylene, linear low density polyethylene and polypropylene, and homogeneous random partly crystalline ethylene-α-olefin copolymers having a narrow molecular weight distribution, as described by Elston in U.S. Pat. No. 3,645,992, and elastic substantially linear olefin polymers (available from The Dow Chemical Company as Engage™ and Affinity™ polyolefins) as disclosed, for example, by Lai et al, in U.S. Pat. No. 5,272,236.

The thermoplastic polymer may also be a physical blend of the above-mentioned polymers or it can take the form of an impact-modified polymer containing a discrete rubbery phase dispersed within the thermoplastic polymer itself. An example of the latter is a material commonly referred to as a thermoplastic polyolefin (TPO), which is a blend of polypropylene and ethylene-propylene (EPR) or ethylene-propylene-diene (EPDM) rubber commonly used in automotive applications. Other examples include poly(styrene-acrylonitrile) copolymer modified with polybutadiene rubber, commonly referred to as ABS, which is frequently used in automotive applications, and blends of ABS and other polymers, such as polycarbonate. In addition, the thermoplastic polymer may contain additive materials such as antioxidants, UV stabilizers, plasticizers, mineral fillers, mold release agents, or a combination of such additives.

The thermoplastic polymer should possess a molecular weight high enough to impart physical properties to the composite that are desired for the particular end-use application. For example, for automotive applications, the polymer should be selected to provide sufficient tensile and impact strength over a range of temperatures, heat and chemical resistance, elongation, and stiffness. The relationship between polymer molecular weight and resulting physical properties varies with the class of polymers considered, however, thermoplastic polymers with molecular weights in excess of about 30,000 typically afford molded or fabricated articles with these desirable property attributes. In addition, the thermoplastic matrix polymer preferably possesses sufficient thermal stability to permit the use of melt fabrication as a means of preparing the blend with the electronically conductive charge transfer complex or semiconducting polymer. Most of the above-mentioned thermoplastic polymers which are commercially available can be melt processed at temperatures where the amount of polymer degradation, if any, is not sufficient to substantially affect the polymer's physical properties.

Examples of suitable thermoset polymers include polyureas, polyurethanes, polyepoxides, polymers used to prepare sheet molding compound (SMC) and bulk molding compound (BMC), including unsaturated polyesters and vinyl ester resins, and mixtures thereof, including combinations of epoxy resins and polyurethane elastomers. Polymers useful for the preparation of sheet molding compound and bulk molding compound are described, for example, in Kia et al., *Sheet Molding Compounds: Science and Technology* (Hanser/Gardner Publications, 1993). The electronically conductive charge transfer complex, inherently semiconducting polymer, or monomer or other precursor for the preparation of either may be incorporated into either component of a two-component or multi-component system for the preparation of such polymers, so long as they do not significantly interfere with the subsequent reaction of the components which form the thermoset polymer. For example, if the polymer is a polyurethane or polyurea polymer, and the ICP is polyaniline, the polyaniline is preferably added to the isocyanate-reactive component. Examples of polyurethane/polyurea reaction components, as well as processes for the preparation of such polymers, are described, for example, in PCT Application No. WO 94/07612 and U.S. Pat. No. 5,055,544, both of which are hereby incorporated by reference. Alternatively, the thermosetting composition used to prepare the composite may be a one-component composition, such as a reactive hot melt adhesive.

In addition to components (a) and (b), the composite may additionally comprise other materials, such as, conductive fillers such as carbon, graphite, and metallic fibers or whiskers, as well as non-conductive fillers, pigments, surfactants, plasticizers, mold release agents, antioxidants, and UV stabilizers. Preferably, the matrix polymer of the composite is present in an amount, based on the weight of the composite, of at least about 10 percent, and more preferably at least about 20 percent.

The conducting thermoplastic composites described above may be prepared by any suitable method for preparing a uniform mixture of components (a) and (b). For example, such mixture may be prepared by adding a doped ICP to the matrix polymer and then blending the two in a suitable solvent, by melt-processing the polymers (a) and (b) together at temperatures above the glass transition temperatures of one of the polymers. It may also be more convenient in some cases to prepare the composite by first preparing a blend or master batch having a relatively high concentration of component (a), extruded pellets of which may then be mixed with pellets of component (b). The final polymer composite would thereafter be prepared at the point at which the pellet mixture is thermally processed and used to manufacture the end-use article. Mixtures containing thermoset polymers may be prepared by incorporating component (b) into any component of a multi-component thermoset system, as described above.

The electronically conducting charge transfer complex or inherently semi-conductive polymer is preferably selected to be chemically/physically stable under the processing conditions used to fabricate the article to be subsequently electromotively coated. For example, component (b) must be thermally stable at the processing temperature if it is to be melt processed, or must be sufficiently soluble or dispersible if a solution processing fabrication technique is utilized.

When combining doped ICPs with the matrix polymer to form the composite, a compatibilizing agent may be utilized to improve the compatibility and/or blending characteristics of the polymers in order to produce a uniform blend of a conductive material which has the most cost-effective amount of ICP necessary to achieve a particular conductivity, and which also has suitable physical properties, such as Young's modulus and impact properties. The term "compatible" as used herein refers to the tendency of the mixture to not undergo gross phase separation from the time the blend is molded or extruded into an article up until the conductive properties of the article are utilized, but also refers to the ability of the blend components to not significantly chemically react with or otherwise degrade each other's physical or conductive properties, and the ability of the ICP to remain relatively uniformly dispersed with the matrix polymer.

Often, the particles of component (b) present in a blend have a tendency to agglomerate excessively within the matrix, resulting in a reduction in overall conductivity of the composite. Optimum compatibilization is achieved when such agglomerization is reduced as much as possible, but a self-assembled conductive network of the ICP particles is still observed. Compatible mixtures of ICPs and matrix polymers may be prepared by doping the ICP with two or more acid dopants of varying equivalent weights. By way of example, if the thermoplastic matrix polymer is a polyolefin, high equivalent weight acid-functional or maleic anhydride-grafted polyolefins, such as ethylene acrylic acid, may be used in conjunction with dodecylbenzenesulfonic acid to dope the ICP. It is believed, without intending to be bound, that the higher equivalent weight dopant improves the compatibility of the ICP and matrix polymers, whereas the lower equivalent weight dopant is more effective to increase the conductivity of the ICP. Other methods for increasing the conductivity of a composite are described, for example, in EPO Application No. 582,919, which discloses a polyaniline/thermoplastic polymer composition containing the reaction product of a metal compound and dopant acid. Preferably, the composite contains both (1) the reaction product of a metal compound and dopant acid and (2) a maleic anhydride-grafted polyolefin.

The conductivity of the composite used in the process of the invention is preferably at least about $10^{-12}$ S/cm, more preferably at least about $10^{-8}$ S/cm, and most preferably at least about $10^{-5}$ S/cm. However, the most preferred conductivity for a particular composite will of course depend on the particular electromotive coating process employed, including the particular equipment utilized to carry out the process, as well as the cost and physical property requirements of the composite. For example, electrodeposition coating and electroplating processes may require a higher conductivity (such as $10^{-3}$–100 S/cm) than electrostatic coating processes. The conductivity of the composite directly affects the coating thickness and uniformity obtainable in an electromotive coating process, as well as the efficiency of the process, under a given set of coating process conditions. As the conductivity increases, thicker coatings as well as less waste of the coating material may be observed. Once a "target" conductivity for a particular coating process is identified, the degree of "improvement" in conductivity for a matrix polymer which is necessary to achieve the target conductivity will depend on its inherent electronic conductivity, since some polymers are naturally more insulating than others. Many polymers commonly used commercially in structural applications have conductivities of less than $10^{-14}$ S/cm. The specific conductivity values given herein are intended to represent the local conductivity of the composite at the point at which it is measured, unless otherwise noted, since the conductivity of the composite may not be completely uniform across the entire sample.

Component (b) is preferably employed in an amount sufficient to increase the electronic conductivity of a composition which is the same in all respects except that it does not contain component (b), by at least a factor of 10, in S/cm. The electronically conductive charge transfer complex or inherently semiconducting polymer is preferably used in an amount sufficient to increase the average conductivity of the composite by a factor of $10^4$, and most preferably by a factor of $10^8$, relative to the same composite prepared in the absence of the complex or semiconducting polymer. Of course, it is necessary for the complex or semiconducting polymer to be more electronically conductive than the matrix polymer for this to occur, but the polymer may possess some degree of electronic conductivity without the complex or semiconducting polymer, as discussed above, or the composite may contain other conductive fillers, such as carbon particles or fibers.

The composites described above for use in the process of the invention may possess advantageous physical properties, such as tensile strength, elongation, room temperature impact strength, and/or low temperature strength, relative to other plastic materials having substances incorporated therein in amounts sufficient to increase their conductivity, particularly for a given target conductivity above about $10^{-5}$ S/cm. Low temperature impact resistance of a material may be determined using ASTM Method No. 3763-8 6(1995) carried out on a Dynatup™ impact testing machine (Model No. 8000) at a temperature of about −29° C. Tensile strength properties of the composites may be tested according to ASTM Method No. D638-876 (1988)

The composite may be molded or extruded into an article and electromotively coated using any suitable technique. For example, thermoplastic composites may be fabricated by thermal processing techniques, such as extrusion, pultrusion, compression molding, injection molding, blow molding, and co-injection molding. Thermoset materials may be fabricated by reaction injection molding techniques, for example, or processes typically employed in the preparation and molding of SMC and BMC, such as compression molding. Once fabricated, the electronically conductive article can be painted or coated on at least one of its surfaces using any suitable electromotive coating process. The term "electromotive" coating process as used herein refers to any coating process wherein an electrical potential exists between the substrate being coated and the coating material. Examples of electromotive coating processes include electrostatic coating of ligands or powders, electrodeposition ("E-Coat") processes, electromotive vapor deposition, and electroplating processes. The article may be painted or coated with any suitable water-based or organic-based composition (or water/organic mixture), including conductive primer compositions which further enhance the electronic conductivity of the article, or with a solventless organic composition by a powder coating or vapor deposition method.

The coated articles prepared by the process of the invention are useful in any application for coated plastic articles, but are particularly useful as components in applications where the use of a lightweight non-corrosive material is desirable, such as automotive and other transportation applications, as well as static-dissipation and shielding applications.

ILLUSTRATIVE EMBODIMENTS

The following examples are given to illustrate the invention and should not be interpreted as limiting it in any way. Unless stated otherwise, all parts and percentages are given by weight.

EXAMPLE 1

A blend containing 400 g of polypropylene (Himont ProFax™ 6323), 170 g of ethylene/octene elastomer (Dow Engage™ 8100) and 110 g of Versicon™ (an organic sulfonic acid-doped polyaniline having a molecular weight of about 60,000–90,000 and a conductivity of about 1.5 S/cm, available from Allied Signal) is compounded on a Welding Engineers 20 mm twin screw extruder at 200 rpm using the following temperature settings: Zone 1=180° C.; Zone 2=190° C.; Zone 3=195° C.; Zone 4=200° C.; Zone 5=205° C.; Zone 6=210° C.; Zone 7=210° C.; Die=200° C.

The extruded blend is cooled in a water bath and pelletized. A 4"×8"×0.125" plaque is compression molded at 200° C. for 5 min. The same blend containing polypropylene and ethylene/octene elastomer without Versicon™ is also compounded and compression molded as a control sample. The plaques are electrostatically painted using the following procedure.

The plaques are rinsed for 60 seconds at 170° F. in a phosphoric acid based detergent (ISW 32, available from DuBois Chemical Corp.), followed by a 30-second deionized water rinse at 160° F., a 30-second rinse at 160° F. in ISW 33, a phosphoric acid based painting conditioning agent (available from DuBois Chemical Corp.), a 30-second ambient temperature deionized water rinse, and a 15-second ambient temperature deionized water rinse.

The plaques are dried with forced air followed by a 30-minute drying in an electric air circulating oven at 160° F. The plaques are cooled to room temperature before painting.

Two coats of paint (CBC9753 White, manufactured by Pittsburg Paint and Glass) are applied to the panels using a SPRAYMATION™ Model 310160 automatic panel sprayer using a Binds Model 80A electrostatic spray gun (63 B fluid dip, N63 air cap, 111-1271 fluid needle). The panels are painted using an 850 inch/minute gun traverse speed, a 2" spray gun index with 50% fan overlap, a 45 psig air atomization pressure, and a 10" gun-to-part distance. Each coat is applied by 8 gun passes (left-right-left) per coat at 80 kilovolts and 56 microamps current. The paint has an unreduced viscosity (Fischer Number 2 Viscosity Cup) of 88 Seconds; a spray viscosity (Fischer Number 2 Viscosity Cup) of 21 seconds; and contains 30 percent by volume isobutyl acetate. Prior to the application of the second coat, the first coat is permitted to flash for 30 seconds. After the application of the second coat, the painted panels are allowed to flash for 5 minutes. The painted panels are subsequently cured in a Despatch Model PWC3-14-1 electric air circulation oven for 40 minutes at a temperature of 260° F.

The standard metal panel support rods on the SPRAYMATION™ are replaced with fiberglass rods of the same dimensions to reduce the attraction of paint to the support rod. The rack cross-members are replaced with oak wood, which is glued on with epoxy resin. Aluminum plates (2) that are 4×6×¼ inches in area are mounted 1 inch apart on the top oak cross-bar with wood screws. A metal bolt is flush mounted to the face of the metal plates. The bolt is centered on the plate and it protrudes on the back where it serves as a grounding point. A grounding wire is attached with a nut and a washer. The ground has a resistivity of 0.15 ohms.

Test samples are mounted in such a way that half of the sample is backed by the grounded aluminum plate and half is unbacked. The test samples are held in place by clamping on the outside edge, onto the aluminum plate with conductive metal clips having a resistivity of no greater than 0.15 ohms. This ensures that the plastic parts are grounded. Masking tape is used to cover any exposed aluminum.

The film thickness on the plastic panels is measured by first cutting a small piece of the painted substrate out of the test samples. The chip is placed painted side down on a flat cutting surface. A cross-section is cut through the plastic and paint layers. The cross-sectional piece is placed on a microscope slide and paint thickness is measured at a magnification of 200 times with a graduated ocular. Film thickness measurements are made on both the aluminum-backed half and the unbacked half of the panels. The results are given in the following table, which shows the paint thicknesses obtained on two separate samples. As used in the table, "% NPani" refers to the weight percent solids of polyaniline, on an undoped basis, present in the sample.

TABLE 1

| Sample | With Aluminum Plate (mil) | Without Aluminum Plate (mil) | % NPani |
|---|---|---|---|
| Control* - Sample 1 | 1.5 | 0.6 | 0 |
| Control* - Sample 2 | 1.5 | 0.5 | 0 |
| Conductive Blend - Sample 1 | 1.8 | 1.7 | 8 |
| Conductive Blend - Sample 2 | 1.8 | 1.7 | 8 |

*Not an example of the invention.

EXAMPLE 2

$Zn(DBSA)_2$ is prepared by the following method: DBSA (320 g) is placed in a large evaporating dish and heated gently while stirring. While warm, 40.7 g of ZnO are slowly added to the DBSA. The mixture is kept under $N_2$ flow. The temperature is slowly raised to the point where the mixture begins to froth and $H_2O$ steam is evolved, which is the boiling of the water formed by the reaction between the acid and the base. The mixture is maintained at this temperature for about 5 hours. (After about 3 hours the steam evolution ceases). The product, $Zn(DBSA)_2$, is allowed to cool to room temperature (about 25° C.), and then is further cooled to about −10° C. The sample is further cooled with dry ice and pulverized into a powder for easier blending.

$Pani(DBSA)_{0.5}$ is prepared by combining neutral polyaniline ("NPani") (obtained from Allied Signal) (93 g) with 161 g of DBSA in about 1.5 liters of toluene. The toluene is sparged with $N_2$ for 15 minutes, and 0.6 g PEPQ (PEPQ powder from Sandoz Chemical Corporation) is added as an antioxidant. The mixture is sonicated at about 40° C. for 2 days.

The $Pani(DBSA)_{0.5}$ and $Zn(DBSA)_2$ are then combined in a 1:1 mole ratio, which is a 1:2.9 weight ratio. The $Zn(DBSA)_2$ is first dissolved in warm toluene, and then solutions of the two are combined. The resulting mixture is blended with polyethylene (Engage™ 8100, available from The Dow Chemical Company) which has been dissolved in warm toluene, in a 64:36 weight ratio (ratio of $Pani(DBSA)_{0.5}$ and $Zn(DBSA)_2$ to Engage™). The solution of these components is poured into a large glass evaporating dish, and the solvent evaporated off in a fume hood. After two days, this mixture is cooled with dry ice, vacuum dried at 40° C. and ground to a consistency which feeds smoothly into a twin-screw extruder, and then dried under vacuum again.

The ground mixture and a blend of polypropylene and ethylene/octene elastomer prepared and compounded as described in Example 1 (in a 1-inch counter-rotating intermeshing twin-screw extruder running at 100 rpm (Brabender extruder/Haake drive)) are combined in amounts sufficient to give the weight percent polyaniline shown in Table 2. Zone temperatures are profiled from 190°–210° C. from the feed throat to the die, respectively. The melt temperature during extrusion varies from 205°–215° C. The molten polymer blend strand is cooled in a water bath and pelletized. Plaques for paint transfer testing are prepared on a Tetrahedron compression molding press at 200° C. and 50,000 psi clamp force. Injection molding of tensile and impact test specimens is carried out on a Boy™ 30 ton injection molding machine. The following conditions were used: Injection temperature—200°–210° C.; Injection pressure—17–22 bar (250–325 psi); Mold temperature −50° C.; Injection time—≈2 sec; Cooling time 20 sec.

Static decay data is obtained using U.S. Military Test No. B-81705B, Method 4046, to measure the time necessary for the 5000 V static change to decay to 500 V at ambient conditions. The molded article is painted according to the procedure given in Example 1. The paint thickness is measured according to the procedure given in Example 1. The results are shown in Table 2. Table 2 also includes the weight percent polyaniline (on an undoped basis) in each of the samples.

EXAMPLES 3–10

Using the procedure given in Example 2, molded articles are prepared using the doped polyanilines and zinc salts shown in Table 2. As additional examples of methods for preparing the mixtures of polyaniline(DBSA) complex and the Zn(DBSA) salts, a 1:1 molar ratio of $Pani(DBSA)_{1.3}$ and $ZnO(DBSA)_{0.74}$ (Example 5) may be prepared by combining solutions of 118 g of DBSA and 40.7 g of ZnO according to the above procedure, to prepare the zinc salt; and combining solutions of 93 g of polyaniline and 418.6 g DBSA to prepare the doped polyaniline. The resulting solutions are then combined and processed as described in Example 2 to obtain a ground solid form of the mixture. Similarly, a 1:1.5 molar ratio of $Pani(DBSA)_{1.3}$ and $ZnO(DBSA)_{0.74}$ (Example 6) may be prepared by combining solutions of 177 g of DBSA and 70.1 g of ZnO according to the above procedure, to prepare the zinc salt; and combining solutions of 93 wg of polyaniline and 418.6 g DBSA to prepare the doped polyaniline. The resulting solutions are then combined and processed as described in Example 2 to obtain a ground solid form of the mixture. In Example 7, the mixture of Pani$(DBSA)_{1.3}$ and $ZnO(DBSA)_{0.74}$ is predispersed in the thermoplastic polyolefin blends instead of the Engage™ 8100.

TABLE 2

| Example | Pani Complex | Wt % Pani (w/o dopant) | Average Static Decay Time at 10% Cutoff | Paint Film Thickness (Unbacked) (mm) | Paint Film Thickness (Backed) (mm) | Conductivity (S/cm) |
|---|---|---|---|---|---|---|
| 2 | [Pani $(DBSA)_{0.5}]_{1.0}$ $[Zn(DBSA)_{2.0}]_{1.0}$ | 1.5 | >50 sec. | 0.7 | — | — |
| 3 | [Pani $(DBSA)_{0.5}]_{1.0}$ $[Zn(DBSA)_{2.0}]_{1.0}$ | 2.0 | 0.01 sec. | 1.2 | — | — |
| 4 | VERSICON™ | 8.0 | 0.03 sec. | 1.7 | — | — |
| 5 | [Pani $(DBSA)_{1.3}]_{1.0}$ $[ZnO(DBSA)_{0.74}]_{1.0}$ | 2.0 | >50 sec. | 0.5 | 1.0 | $10^{-15}$ |
| 6 | [Pani $(DBSA)_{1.3}]_{1.0}$ $[ZnO(DBSA)_{0.74}]_{1.5}$ | 2.0 | 0.02 sec. | 1.2 | 1.5 | $10^{-10}$ |
| 7 | [Pani $(DBSA)_{1.3}]_{1.0}$ $[ZnO(DBSA)_{0.74}]_{1.5}$ (predispersed in TPO) | 4.2 | 0.01 sec | 1.6 | 1.5 | $3 \times 10^{-8}$ |
| 8 | [Pani $(DBSA)_{1.3}]_{1.0}$ $[ZnO(DBSA)_{0.76}]_{1.5}$ | 1.0 | — | 0.5 | — | — |
| 9 | [Pani $(DBSA)_{1.3}]_{1.0}$ $[ZnO(DBSA)_{0.76}]_{1.5}$ | 1.0 | — | 0.6 | — | — |
| 10 | [Pani $(DBSA)_{0.5}]_{1.0}$ $[ZnO(DBSA)_{1.8}]_{1.5}$ | 2.0 | 0.01 sec. | 1.3 | — | — |

"—" - data not obtained

What is claimed is:

1. A process for preparing a coated article which includes the step of electromotively coating an article molded or extruded from a composition having a conductivity of at least about $10^{-14}$ S/cm, which comprises (a) a thermoplastic polymer, reactive components for preparing a thermoset polymer, or a mixture thereof, and (b) an electronically conductive charge transfer complex or inherently semiconducting polymer different from (a), provided that if component (a) is a thermoplastic polymer, the composition is molded or extruded at a temperature above the glass transition temperature of the polymer.

2. The process of claim 1 wherein the composition has a conductivity which is at least ten times greater, in S/cm, than the conductivity of a composition which is the same in all respects except that it does not contain component (b).

3. The process of claim 2 wherein the composition has a conductivity which is at least $10^4$ times greater, in S/cm, than the conductivity of a composition which is the same in all respects except that it does not contain component (b).

4. The process of claim 2 wherein the composition has a conductivity which is at least $10^8$ times greater, in S/cm, than the conductivity of a composition which is the same in all respects except that it does not contain component (b).

5. The process of claim 1 wherein the component (b) is a doped intrinsically conductive polymer.

6. The process of claim 5 wherein the intrinsically conductive polymer is polyaniline.

7. The process of claim 5 wherein the intrinsically conductive polymer is polypyrrole.

8. The process of claim 5 wherein the intrinsically conductive polymer is polythiophene.

9. The process of claim 5 wherein the composition contains less than 25 percent by weight of the doped intrinsically conductive polymer.

10. The process of claim 9 wherein the composition contains less than 10 percent by weight of the doped intrinsically conductive polymer.

11. The process of claim 5 wherein the component (a) is a thermoplastic polymer.

12. The process of claim 11 wherein the component (a) is a thermoplastic polyolefin.

13. The process of claim 11 wherein the component (a) is a thermoplastic polycarbonate.

14. The process of claim 5 wherein the component (a) is a thermoset polymer.

15. The process of claim 14 wherein the thermoset polymer is a polyurethane or polyurea.

16. The process of claim 5 wherein the composition is prepared as a sheet molding compound or bulk molding compound.

17. The process of claim 16 wherein component (a) is an unsaturated polyester resin.

18. The process of claim 5 wherein the conductivity of the composition is at least about $10^{-12}$ S/cm.

19. The process of claim 18 wherein the conductivity of the composition is at least about $10^{-8}$ S/cm.

20. A process for preparing a coated article which includes the step of electrostatically coating an article molded or extruded from a composition having a conductivity of at least about $10^{-14}$ S/cm, which comprises (a) a thermoplastic or thermoset polymer, and (b) an electronically conductive charge transfer complex or inherently semiconducting polymer different from (a), provided that if component (a) is a thermoplastic polymer the composition is molded or extruded at a temperature above the glass transition temperature of the polymer.

21. A process for preparing a coated article which includes the step of electroplating an article molded or extruded from a composition having a conductivity of at least about $10^{-5}$ S/cm, which comprises (a) a thermoplastic or thermoset polymer, and (b) an electronically conductive charge transfer complex or inherently semiconducting polymer different from (a), provided that if component (a) is a thermoplastic polymer, the composition is molded or extruded at a temperature above the glass transition temperature of the polymer.

* * * * *